US006068261A

United States Patent [19]

Nettle

[11] Patent Number: 6,068,261

[45] Date of Patent: May 30, 2000

[54] ARCHERY TARGET AND METHOD OF REPAIR

[76] Inventor: Robert Nettle, P.O. Box 5387, Slidell, La. 70469

[21] Appl. No.: 09/105,367

[22] Filed: Jun. 26, 1998

Related U.S. Application Data

[63] Continuation-in-part of application No. 08/851,043, May 5, 1997, abandoned.

[51] Int. Cl.[7] ..... F41J 3/02

[52] U.S. Cl. ..... 273/408; 273/403

[58] Field of Search ..... 273/403, 404, 273/407, 408

[56] References Cited

U.S. PATENT DOCUMENTS

| | | | |
|---|---|---|---|
| 4,054,288 | 10/1977 | Perrine, Sr. | 273/407 |
| 4,239,236 | 12/1980 | Parham et al. . | |
| 4,477,082 | 10/1984 | McKenzie . | |
| 4,597,574 | 7/1986 | Wolfe | 273/403 |
| 5,002,285 | 3/1991 | Morrell . | |
| 5,308,084 | 5/1994 | Morrell . | |

FOREIGN PATENT DOCUMENTS

| | | |
|---|---|---|
| 78034718 | 10/1979 | Australia . |
| 2572804 | 5/1986 | France . |
| 4039491 | 6/1992 | Germany . |
| 2229373 | 9/1990 | United Kingdom . |

OTHER PUBLICATIONS

Stanley Hips' Targets Advertisement Three pages, Sep. 1984.

Flyer from PTI Broadhead Target, Milford, CT, USA.

*Primary Examiner*—Sam Rimell
*Attorney, Agent, or Firm*—Robert N. Montgomery

[57] ABSTRACT

An archery target having a solid clay core surrounded by a high density foam wherein the core is capable of stopping an inestimable number of broadhead-tipped arrows in a manner nondestructive to either the arrows (or any components thereof) or the target itself. The clay core is essentially indestructible and can be restored to a like new condition through a simple procedure compressing the arrow holes remaining in the clay, the clay being formulated to allow easy withdrawal of broadhead arrows without damage to the arrow and with a minimum of residual material left on the arrow. Multiple clay cores may also be used to represent vital areas of an animal and/or as multiple bull's-eye for a target.

13 Claims, 4 Drawing Sheets

ARCHERY TARGET AND METHOD OF REPAIR

This is a continuation-in-part application of U.S. patent application Ser. No. 08/851,043 filed May 5, 1997 now abandoned.

BACKGROUND OF THE INVENTION

1. Field of the Invention

The invention relates to archery targets in general and more particularly to targets intended for use with broadheads (multi-bladed, razor-edged arrow tips used for hunting) featuring dual composites and having a central core or bull's-eye area comprising a higher density than the surrounding area of the target.

2. General Background

The most important function of archery targets, even transcending their application as objects intended to improve bow shooting skills, is safely and reliably stopping arrows. All manner of materials have been tested in modern archery targets in efforts to identify those sufficiently durable to serve that purpose. Constructing a target for use with broadheads makes identifying appropriate materials even more problematic; not only does their effect on the flight characteristics of arrows increase the need for practice, but their inherently destructive nature assures the rapid degradation of any material used in target design. The kinetic energy behind arrows released from modern compound bows generates such penetrative force that heretofore no material has proven sufficiently resilient to bridge the gap between supporting extensive use of, and withstanding the damage inflicted by, broadheads. Add to those stringent requirements the need for a target to be portable, economical, and 100 percent reliable (for stopping arrows); and a significant void is identified. Targets designed to be used with broadheads have developed along four distinct strategic lines. The most obvious and pervasive strategy is based on attempts to employ materials able to withstand the repeated impact, penetration and cutting action of broadheads without degradation to arrows or their components while sustaining minimal damage to the target itself. This is a critical factor because broadheads were developed for hunting and are designed to maximize impairment.

The second strategy involves increasing target mass (sometimes only two of three dimensions are modified), so that, through intentionally selective shooting, users are able spread target wear over a greater area, thus assuring a longer target life-essentially, by rationing target depletion. The concept is based on an implicit understanding that, during normal use, materials employed in broadhead targets will cumulatively sustain irreparable damage that eventually renders them unable to fulfill their function.

Some manufacturers employing either of the above strategies offer optional accessories to extend the usable life of their targets. These include replaceable target covers to provide more cosmetically appealing target surfaces and specialized backstops intended to halt arrows that would otherwise pass completely through the target-these also wear to a point of unreliability. Such accessories substantiate an awareness by target manufacturers of the vulnerability of materials used in the construction of broadhead targets.

The third strategy, a physical application of the Pareto Principle (the 80/20 rule), incorporates a replaceable core to extend target life. The designed obsolescence of a replaceable (more accurately, disposable) core once again confirms the ineffectiveness of materials currently used in target design. Further complicating the implementation of this configuration, as target borders adjacent to a core degrade, it becomes increasingly more difficult, ultimately impossible, for a replaceable core to be securely mounted in the target.

The fourth strategy is demonstrated by targets employing a resilient material implemented in polyhedral configurations (having from six to 26 sides) to maximize the use of target surface area. While having the cosmetic appeal of providing numerous target surfaces (although each degrades with use), such designs provide little additional fortification to the internal core of the target, which is sustaining cumulative damage with each successive arrow penetration.

The common element of target design strategies is reliance on materials incapable of withstanding the cumulative destructive force of broadheads in any quantitatively substantial measure. That failure is most readily discernible in the disparity between benchmarks commonly applied to evaluate the effectiveness of archery targets: a target's shot rating (the number of shots before a target is exhausted) and a target's pass-through rating (the number of shots to one area of a target before an arrow passes completely through it without being stopped). The ratio between any given target's shot rating and pass-through rating, while varying considerably, ranges from as low as two-to-one to as high as nine-to-one (targets having lower ratios are invariably those providing extremely limited product lives). Because the target cores described herein have neither indicated any signs of exhaustion nor allowed a single arrow pass-through, a comparative ratio is not possible—a benchmark in its own right. With this sole exception, broadhead targets are universally represented as having a product life span significantly beyond the point of reliably stopping arrows. The development and direction of these strategies for target design establish a universal acknowledgment of the need for more durable materials. Their evolution toward employing methods to circumvent the availability of a material impervious to the requisites of such demanding use tacitly prove the commonality (within the art) of the perception that such material does not exist. The drive to improve product performance viewed in concert with the relative ineffectiveness of materials currently in use, and the prevalence with which the aforementioned circumventive measures are implemented throughout the art, establish the desperate need of a more effective approach.

As more sophisticated bows are developed (i.e., high-powered compound bows with aggressive cams, overdraws, and/or high let-off bows), making regular adjustments to maintain the delicate balance required for consistent accuracy becomes increasingly more critical. Bow tuning involves optimizing all mechanical and non-mechanical aspects of bow use to achieve consistent arrow flight characteristics. Although an extremely important procedure, it's typically accomplished at an archery pro shop, and therefore not performed (or checked) as routinely as would be advisable to assure optimum performance.

Bow tuning requires determining the precise attitude of an arrow during flight. This is traditionally accomplished by shooting an arrow through a single sheet of paper held in position by a frame. The perforation made in the paper indicates arrow attitude and can be interpreted to identify specific bow problems. When a bow is properly, tuned a bullet-like hole will appear in the paper, indicating that the arrow point and fletching entered the same hole. The unique colloidal nature of the clay core implemented in said invention, when freshly resurfaced, effectively serves as an arrow flight recorder and enables paperless bow tuning—a significant development that provides archers major advantages in setting up, maintaining and monitoring, and thereby improving, the performance of modern compound bows.

A problem common to all targets used with broadheads occurs when the insert joining it to an arrow shaft pulls out while extracting the arrow, leaving the broadhead embedded in the target. This represents a safety hazard, as well as potentially endangering the components of all arrows subsequently shot into areas adjacent to the location of the buried broadhead. One of the most common solutions is to visibly mark the area and attempt avoiding shots into any target area in which a broadhead has become dislodged. As this occurs repeatedly, it becomes increasingly more difficult to avoid damaging the components of arrows subsequently shot into the target. The target core described herein represents the first implementation of a medium enabling archers to gain access to and retrieve an embedded broadhead, through digging or scooping out the clay until the arrow tip can be safely removed, and restore the target to its original state.

It is therefore an object of the present invention to provide a broadhead archery target able to indefinitely extend product life expectancy of the medium while concurrently providing a 100 percent level of reliability (i.e., zero arrow pass-throughs) throughout the product life span. The impact relative to economic value (unequaled on a cost per shot basis, let alone taking into consideration the elimination of replaceable cores, target covers and target backstops), environmental soundness (outlasting other broadhead targets in multiples ranging from few to many), safety enhancement, protection of equipment, and the intangible benefit resulting from the correlation between enabling unlimited practice and the potential level of skill development with this product is incomparable to any other broadhead target made.

It is another object of this invention that the properties of the clay (its plasticity and malleability) used in the target's core facilitate the retrieval of embedded broadheads while enabling it to be subsequently and readily restored to a like new condition.

It is also an object of the invention to provide a portable archery target that can be used to perform paperless bow tuning.

Yet another object of the invention is to provide a target surface that can be readily configured with a bull's-eye of any size (up to the core diameter) or shape, and easily and repetitively restored to a like new condition innumerable times throughout the target's life span.

Another object of the invention is to provide a broadhead archery target having a combination of high density polyurethane foam body with a clay core, wherein the density of the foam and the plasticity of the clay core assures that arrows can be easily removed.

It is another object of the invention to provide a broadhead archery target having a clay core that significantly reduces the likelihood of inadvertently bending arrows during extraction.

Still another object of the invention is to provide a target with physical characteristics (dimensions and weight) which enable it to remain stable in a self-supporting upright position.

It is also an object of the invention to provide a target having synthetic clay formulated so as to not adhere to any significant extent to an arrow shaft or broadhead.

Yet another object of the invention is to improve upon the method used to bond cores into a foam archery target.

A further object of the invention is to provide a target which eliminates much of the debris associated with the gradual degradation of foam used in most targets.

Still a further object of the invention is to use a latex paint to protect the polyurethane foam from being damaged by ultraviolet rays, thus extending target life.

A further object of this invention is providing visible indications of the status of bow performance each time an arrow is shot into the target's freshly resurfaced core; bow sight alignment is verified when the arrow is released and bow tuning can be verified when the arrow is extracted from the target.

SUMMARY OF THE INVENTION

The above features, objects and advantages of the invention disclosed herein are attained by providing a closed cell foam body of any configuration having a structural density of between 8–10 pounds per cubic foot. The foam, having a tough pliable outer skin, and a clay central core area comprised of calcium carbonate and petrolatum having a density of 90–110 pounds per cubic foot, being poured in a manner whereby a cavity is provided for insertion of the clay core. However, the foam may be poured around the clay core, thus bonding the two into a unitized body. The foam may be molded into any geometric or animal shape desired and the clay core may be placed in position within the foam. In addition, multiple clay cores may be placed within the foam body.

The core is reformable by compaction of the clay; clay density is maintained by periodic compaction to assure optimum arrow stopping ability of the target. Pressure exerted on the foam as a result of compacting the clay core also tends to facilitate the closure of wounds in the foam portion of the target. A special formulated clay is provided, which prevents binding of broadhead arrows in a manner which may make the arrow difficult to extract-the amount of force required to extract an arrow from the clay core varies with temperature, but can be easily accomplished with one hand by most adults. The clay material leaves a minimum of residual material on the arrow tip and shaft. The smooth and regular surface of a freshly restored clay core target is capable of accurately reflecting the flight attitude of arrows shot into it. The plasticity of the clay allows the arrow to make a clean entry in the core; when freshly resurfaced, any deviation from a perfect ring (e.g., the elongation of a penetration hole) immediately adjacent to the shaft of an arrow provides an indication of arrow attitude during flight that can be interpreted to tune and adjust bows.

By enabling dislodged (and embedded) broadheads to be retrieved, clay core targets not only eliminate safety hazards; but viewed from the perspective of the numerous targets it could take to equal their product life, represent potentially significant savings in the replacement of damaged arrow components.

Further details as to the construction and method of use of the invention may be obtained from a reading of the following drawings and Detailed Description of the Preferred Embodiment.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein;

FIG. 6 is a partial view of the clay core illustrating self-healing of impressions made by arrows.

DETAILED DESCRIPTION OF THE PREFERRED EMBODIMENT

The disclosed target's 10 unique implementation of a target border 14 as a containment vessel for a solid amorphous material 12 possessing properties of plasticity and malleability that assure imperviousness to the wear inflicted on a medium used to stop broadhead-tipped arrows provides exponential improvements, many unanticipated, over previously existing art.

Figure 2:
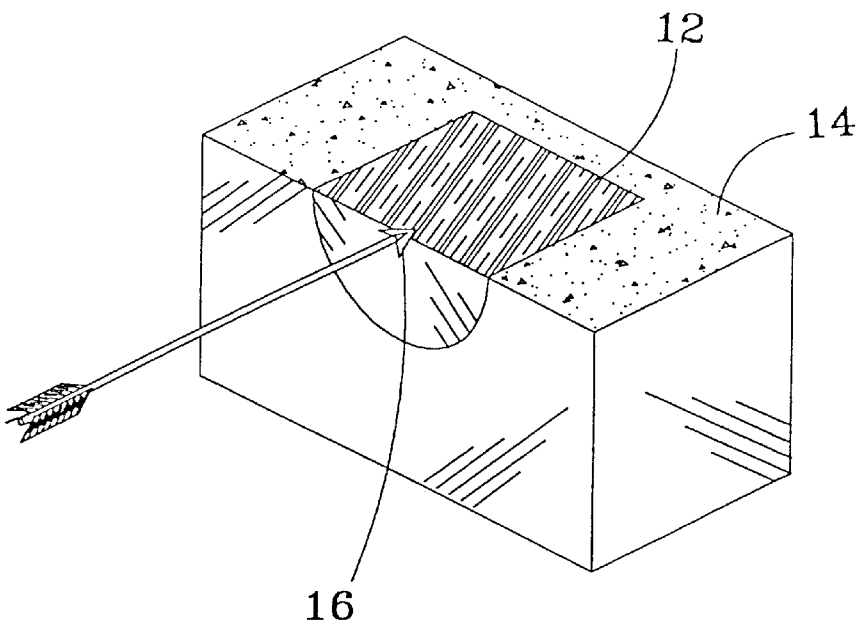
FIG. 2 is an isometric cross section view taken along sight line 2—2 in FIG. 1.
Figure 1:
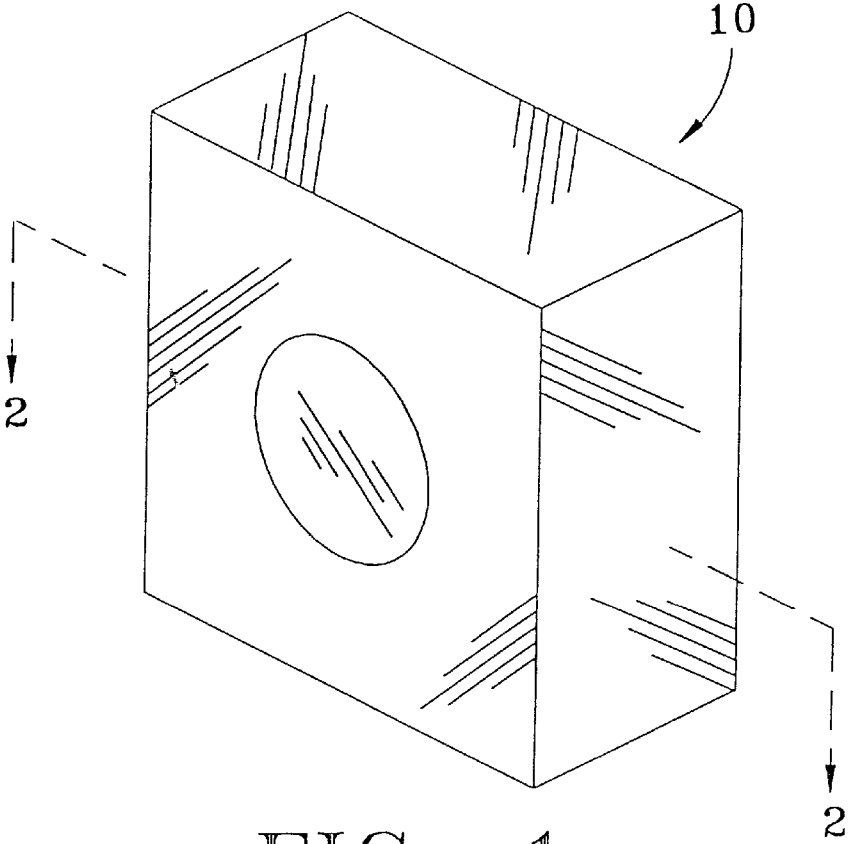
FIG. 1 is an isometric view of a clay/foam archery target in block form.
Figure 4:
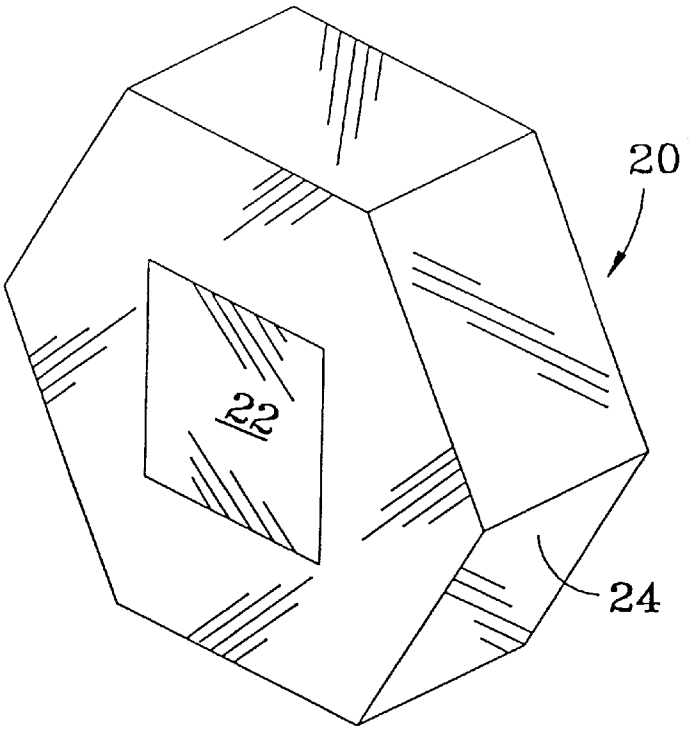
FIG. 4 is an illustration of a foam target with multi-geometric facets with a square clay core.

Turning first to FIG. 1, we see a block type target 10 having a solid, clay center core 12. As seen in the cross section view of FIG. 2, the clay core 12 is integral with and completely surrounded by urethane foam 14. It is preferred that a good grade of poured-in-place, high density, closed cell, urethane foam 14 be used, having a density of 8–10 pounds per cubic foot, thereby providing excellent structural rigidity with a maximum plasticity and tough outer skin. No perimeter frame is required due to the structural integrity of the foam. The foam is poured in a mold having a wood core member, thereby creating a cavity in the foam to allow for insertion of the clay core. However, in some cases, it may be advantageous to pour the foam with the clay core in place. It is anticipated that the foam may be poured in any geometrical configuration, such as the geometric-shaped foam target 20 illustrated in FIG. 4, or take the form of any animal shape, such as the deer 30 depicted in FIG. 3. The clay core 12 as seen in FIG. 1 may also be shaped in any configuration, for example a square 22 as seen in FIG. 4.

Although a number of commercially available clays may be used or formulated for such use, it has been found through trial and error that not all clays have the proper characteristics. Such characteristics include: the ability to prevent through penetration of an arrow having a velocity between 200 to 350 feet per second without damage to the shaft or its broadhead tip; the ability to release the arrow with minimal force and with little or no residue remaining on the arrow and broadhead; the ability to be relatively easily reformed by compaction and also be economical to construct and maintain.

Figure 3:
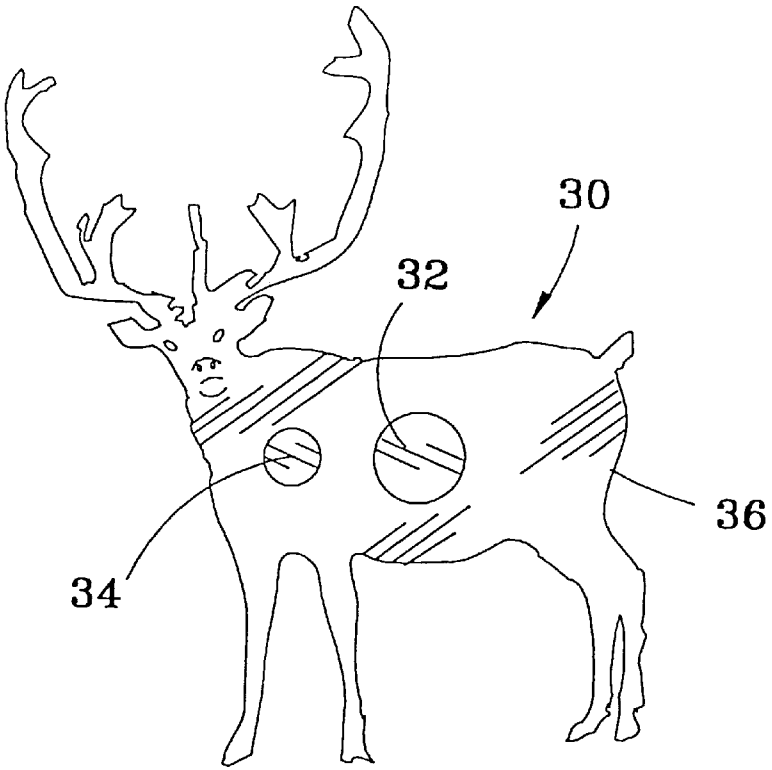
FIG. 3 is illustration of a foam animal form with multiple clay cores.
Figure 5:
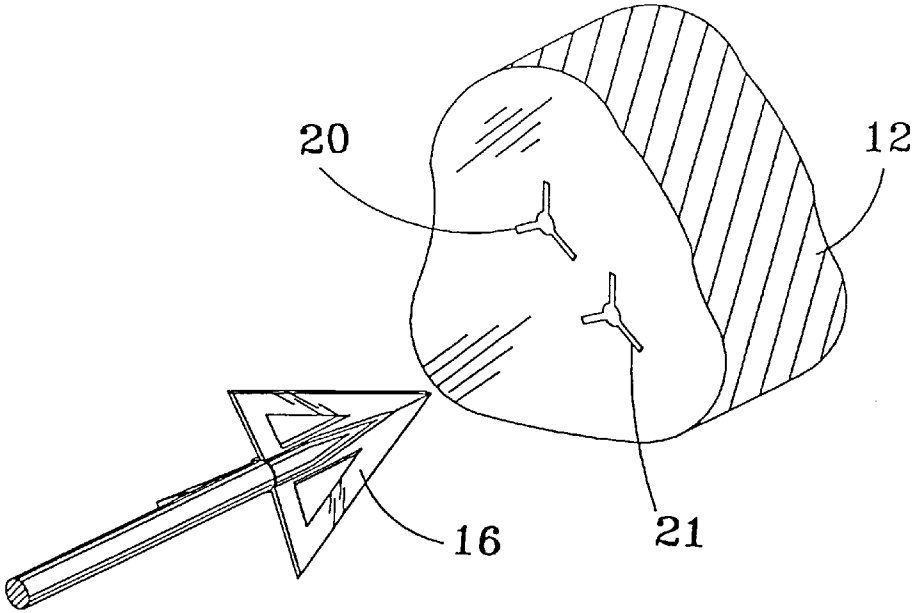
Figure 6:
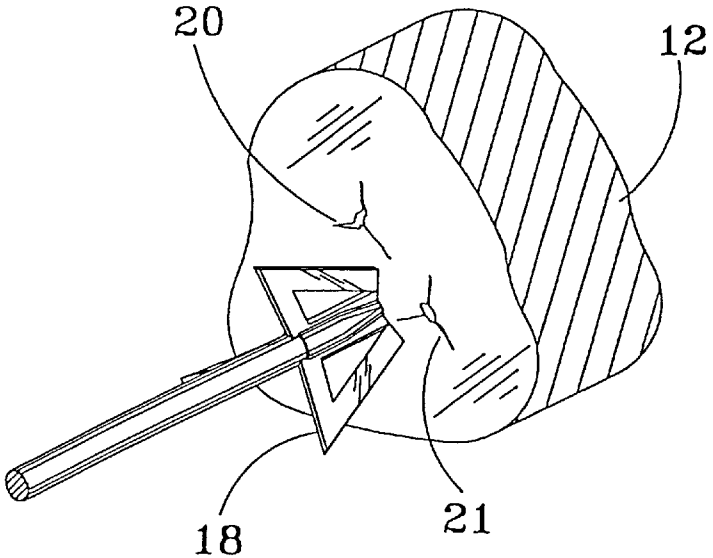
FIG. 6 is a partial view of the clay core illustrating impressions made by broadhead-tipped arrows.
Figure 7:
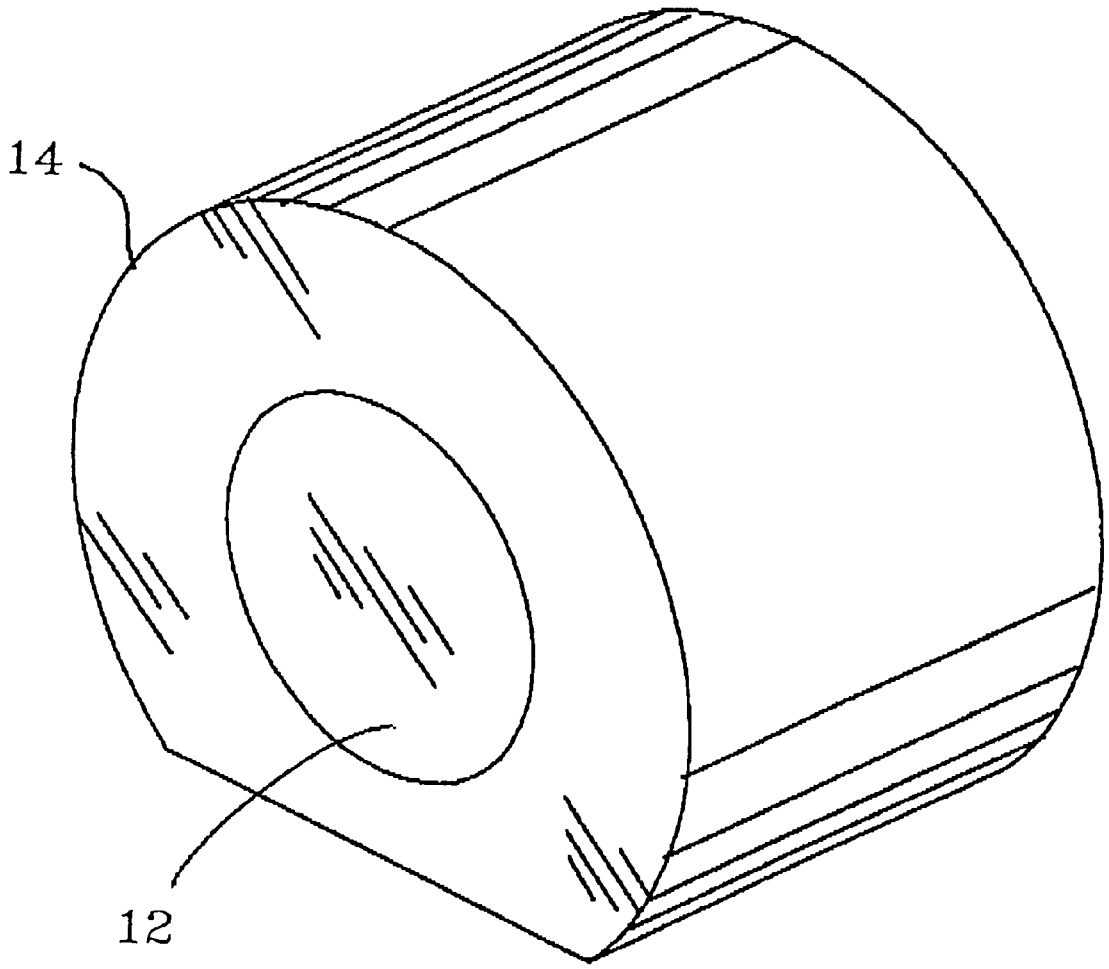
FIG. 7 is an illustration of the preferred embodiment of a foam target with a clay core.

The preferred embodiment as seen in FIG. 7 utilizes high density urethane foam 14 surrounding a clay core 12 considered to be a semi-self-healing type, composed essentially of a special formulation of calcium carbonate and petrolatum and other additives, such as limestone, wax, oils, and talc. Such clays are highly malleable, absorbing the impact energy of arrows tends to seal the holes left by the penetration of others previously shot into the target as illustrated in FIGS. 5 and 6. To produce such a quality, the clay core 12 must be non-hardening, even under extreme outdoor weather conditions. It must be of a high density type with good temperature stability. It is also essential that the clay core 12 be highly compacted. Therefore, as seen in FIG. 5, when an arrow 16 is removed from the clay core 12, it leaves a penetration wound 20,21 and, when the clay core 12 is then struck by a second arrow 18 in the vicinity of the first wound 20,21, as seen in FIG. 6, the clay material 12 tends to shift, thus closing the previous wound 20,21 produced by the first arrow 16. Tamping the clay core 12 periodically by pounding with a two pound maul effectively solidifies the core. The clay core 12 also must be sufficiently dense to prevent deep penetration of the arrows 16, 18. Therefore, the clay should have a density of 90–110 pounds per cubic foot and may be selected from the Plasticene group, containing plasticisers which allow the material to be malleable. However, it is obvious that the greater the velocity of the arrow, the greater the penetration. Since the diameter and depth of the clay core should be kept to a minimum to remain economical, it is essential that the density be maintained by periodic repacking and compacting. The clay core 12 is generally between 10 and 13 inches deep and between 6 and 8 inches in diameter and should be fully enclosed on all sides by the foam, except for the face. However, there is no limitation as far as size or number of clay cores which may be used in a target. For example, multiple clay cores 32, 34 of different sizes may be enclosed in a foam body 36 as seen in FIG. 3. It should be understood that as the clay core 12 is pounded during the compaction process, usually after every 20 to 30 shots, the clay expands diametrically, thus imparting a force on the foam 14, which tends to help close wounds in the foam, but also reduces the core depth. It should be noted that the foam target may be several inches deeper than the clay core depth, thus serving to provide a rigid, structural backing for the clay core.

When the target's border is penetrated by an arrow, the self-healing foam is compressed radially outward from the center of an arrow shaft. Once an arrow has been removed, it's an intrinsic property of the material to gradually return to its former state, thus sealing the hole. Regardless of its position on the target surface, half of any arrow perforation faces the target core; as the clay core is compressed by the impact of a maul, portions of that energy are directed radially outward through the target and will facilitate the foam returning to its normal state. In the event the border adjacent to the clay core begins to sustain damage, during recommended restoration of the core (i.e., laying the target on it's back and striking the core's surface with a two pound maul several times to compress the clay), clay expands into the areas in which the foam has degraded. This procedure not only assures that the core is securely mounted in the target, but because it induces pressure radiating outward from the target's center, facilitates the self-healing properties of the polyurethane foam, thereby reinforcing the body of the target.

If a broadhead tip becomes dislodged in the clay core, it can be retrieved by simply digging the clay from around the tip. When the broadhead has been extracted, the clay can be repacked by returning the extracted clay and compacting the clay by pounding with a two pound maul. It is this reforming process that makes this combination target impervious to wear, thus outlasting all other broadhead targets. The targets described herein have an inestimable product life span, based on clay cores having proven ability to sustain in excess of 10,000 broadhead shots without a single arrow pass-through and having no foreseeable point of exhaustion-while enabling the restoration of a like new target surface innumerable times by compressing the clay and making a circular impression therein to serve as a bull's-eye. It is, therefore, safe to say that the clay core is virtually indestructible as an archery target.

Clay core targets may also be used with any weapon, provided such targets have adequate encasements surrounding the foam portion and that the foam has sufficient density for the load used.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An archery target comprising; a composition for capturing arrows shot from an archery bow at high velocity comprising a compacted solid clay core having a density between 90–110 pounds per cubic foot said clay formulated in a manner whereby said arrows, including broadhead arrows, fired at a velocity of 350 per second make minimal penetration and may be readily removed from said clay core without significant clay adhesion, and a closed cell, structural foam body having a density between 8–10 pounds per cubic foot surrounding said solid clay core.

2. The archery target according to claim 1 wherein said foam body further comprises a means for stabilizing and protecting said foam from degradation for outdoor use consisting of a latex coating.

3. An archery target comprising a non-removable solid clay core having a formulated composition for capturing broadhead tipped arrows shot from an archery bow at high velocity the composition comprising a compacted non-removable solid clay core comprised of approximately 46% silica, 39% alumna and 15% other including Bentonite and fluxes such as Talc chosen from a group consisting of nepheline, syenite alkalis and feldspars, having a compacted density of between 90 and 110 pounds per cubic foot, and a body portion surrounding said clay core comprised of high density, closed cell urethane foam having a density of between 8–10 pounds per cubic foot.

4. The archery target according to claim 3 wherein said foam further comprises a tough outer skin.

5. The archery target according to claim 3 wherein said foam body portion is formed in a cylindrical shape, having at least one flat side extending along length of said cylindrical shape for supporting said target.

6. The archery target according to claim 3 wherein said clay core is reformed after repeated penetrations by broadhead-tipped arrows by compacting said clay core with a maul.

7. The archery target according to claim 3 wherein said clay core further comprises calcium carbonate and petrolatum formulated compounds which do not bind said broadhead tipped arrows, thus allowing relatively easy withdrawal and leaves a minimum clay residue upon said broadhead after removal.

8. The archery target according to claim 3 wherein said target further comprises a plurality of non-removable clay cores.

9. A method for closing arrow wounds in an archery target comprising a composition for capturing arrows shot from an archery bow at high velocity comprising a clay core with a foam body surrounding said clay core comprising the step of repetitious compacting said clay core thereby closing wounds in said clay and compressing said foam body.

10. A method of repairing a broadhead arrow archery target comprising a composition for capturing arrows shot from an archery bow at high velocity the composition comprising a self supporting foam body at least partially surrounding a compacted clay core having at least one flat side and a smooth target surface the method of repair comprising the steps of:

a) using a minimal force to remove any said broadhead arrow present in said target from said target without damaging said broadhead arrow and without any significant damage to said clay core;

b) repairing wounds to said clay core and closing wounds in said foam by pounding said clay with a two pound maul; and c) adding additional clay as necessary to maintain said smooth target surface.

11. The method according to claim 10 further comprising the step of tuning said bow by visually referencing arrow shaft angle of penetration in said clay core.

12. The method according to claim 10 further comprising the step of increasing the useful life of said archery target in excess of ten-thousand broadhead arrow shots from said bow fired at high velocity of up to 350 feet per second by providing said clay core as the kill zone of an archery target.

13. The method according to claim 12 wherein said compacting of said clay core further includes the step of forming a bull's eye in a surface of said clay by impressing a ring therein.

* * * * *